United States Patent [19]

Dillon

[11] Patent Number: 4,554,504

[45] Date of Patent: Nov. 19, 1985

[54] NEGATIVE RESISTANCE COMPENSATED TRANSFORMER

[75] Inventor: Philip L. Dillon, Arlington, Tex.

[73] Assignee: Reliance Electric Company, Cleveland, Ohio

[21] Appl. No.: 605,646

[22] Filed: Apr. 30, 1984

[51] Int. Cl.[4] ..... H01F 15/18

[52] U.S. Cl. ..... 323/356; 333/217

[58] Field of Search ..... 323/255, 340, 343, 356, 323/359, 361; 333/216, 217; 179/170 D, 170 G, 170 R

[56] References Cited

U.S. PATENT DOCUMENTS

| | | | |
|---|---|---|---|
| 4,028,505 | 6/1977 | Fassino | 179/170 G |
| 4,220,875 | 9/1980 | Lawton | 333/217 |
| 4,350,964 | 9/1982 | Chambers, Jr. | 333/216 |

FOREIGN PATENT DOCUMENTS

| | | | |
|---|---|---|---|
| 2738840 | 6/1978 | Fed. Rep. of Germany | 333/124 |

*Primary Examiner*—Peter S. Wong
*Assistant Examiner*—Judson H. Jones
*Attorney, Agent, or Firm*—Michael M. Rickin

[57] ABSTRACT

A compensated circuit for use in interfacing a transmission device to a cable facility. The circuit includes a transformer one winding of which is connected to the cable facility and the other winding of which is connected through an impedance generating device to the transmission device. The circuit provides a predetermined one of a number of selectable impedances to the cable facility. The impedance generating device allows the desired impedance to be elected and includes a negative resistance generating circuit which responds to the current flowing in the loop formed by the winding and the impedance generating device.

11 Claims, 10 Drawing Figures

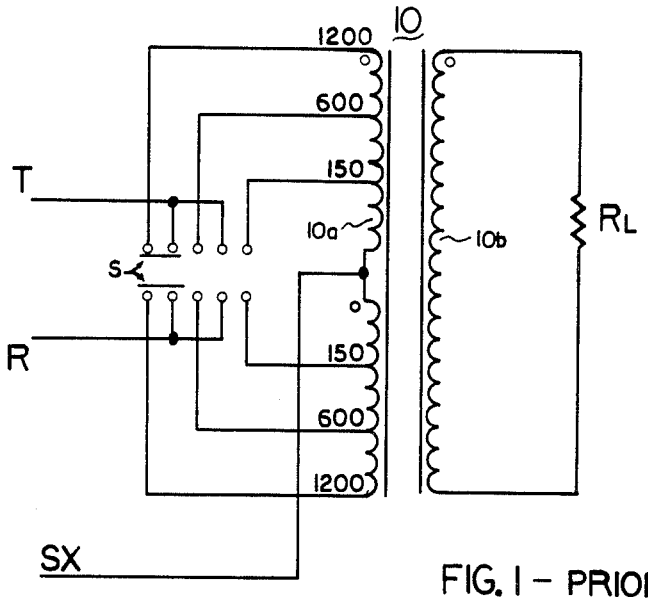
FIG. 1 - PRIOR ART
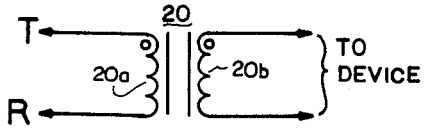
FIG. 2a
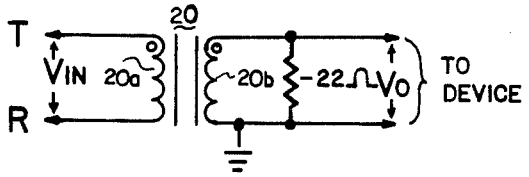
FIG. 2b
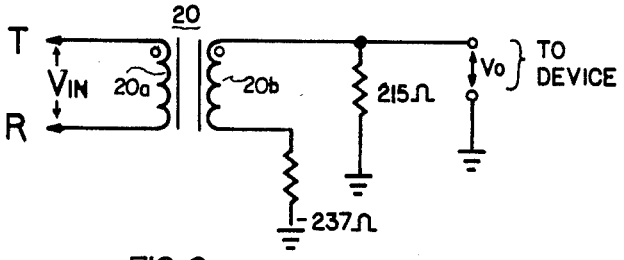
FIG. 2c A1
R9
S4
R8
S3
R7
C1
R6
R5
R4
R10
R11
A2
R1
R2
30a
R3
RT1
30
S1
S2
R12
R13
R14
A3
+V
CR3
CR4
CR2
20b
3
4
-V
CR1
20
1
2
20a

-RN
RS
I

RN/RS · VRS

VRS

AV=RN/RS

NEGATIVE RESISTANCE COMPENSATED TRANSFORMER

BACKGROUND OF THE INVENTION

1. Field of the Invention

This invention relates to transformers and more particularly to a compensated transformer for use in interfacing a transmission device to a cable facility in a manner such that a predetermined one of a number of selectable impedances is provided to the cable facility.

2. Description of the Prior Art

Transmission devices often interface a cable facility through a transformer. The use of a transformer is desirable in that it provides isolation between the cable facility and the transmission device. The transmission devices are often required to have selectable input and output impedances so that the same device may be usable with both non-loaded and loaded cables. A common requirement for voice frequency transmission devices is to have such impedances selectable at 150 and 600 ohms in order for the device to interface with non-loaded cable and selectable at 1200 ohms in order for the device to interface with loaded cable.

In addition to the selectable input and output impedances described above it is also desirable that the envelope delay distortion to the signal passing through the transformer be held to less than 50 microseconds at 300 Hz. In order for the transformer to both interface an impedance of 1200 ohms and have the above desired envelope delay distortion performance it is necessary to provide an inductance of greater than three (3) henries in the transformer. The transformer may be implemented using either a pot core or a laminated core using nickel iron material. It is desirable to implement the transformer using a pot core as transformers of that type provide both good cross talk isolation and a predictable amount of inductance for a given number of turns. In addition, the pot core type of transformer is much less expensive than the nickel iron lamination type. Unfortunately, since the permeability of pot core material is less than that of nickel iron laminations, for a given transformer size of the pot core type a large number of turns must be wound in the transformer in order to provide the above inductance.

For small transformers the winding resistance resulting from those large number of turns, while tolerable at 1200 and 600 ohms, becomes quite intolerable at 150 ohms when a simple, untapped transformer is used. The winding resistance may be so large that it exceeds the required 150 ohm impedance making it impossible to have that impedance. Even if the winding resistance does not exceed the required impedance, it may so dominate that impedance that the winding resistance forms the bulk of the 150 ohm impedance. In this case the transformer is extremely lossy.

A typical transformer specification permits a 10 to 15 percent allowable variation on winding resistance independent of any changes in resistance with temperature. This gives rise to a wide range of variations in winding resistance for pot core transformers of the same size. It is therefore necessary to provide a factory gain compensation adjustment in the transmission device during its manufacture. This wide variation in winding resistance also affects return loss. These variations in return loss can not be compensated for without an additional factory adjustment. The prior art solution to out of tolerance return loss is usually to replace the transformer. In addition, the return loss and the impedance of the transformer are extremely temperature sensitive. The copper which is used to make the needed turns changes its resistivity with changes in temperature at the well known rate of 0.39%/°C. Thus, the use of small pot core transformers to provide both the desired impedance matching as well as the desired limits on envelope delay distortion gives rise to problems.

SUMMARY OF THE INVENTION

A compensated circuit for use in interfacing a transmission device to a cable facility. The circuit provides to the cable facility an impedance which is selected from one of a predetermined number of impedances.

The circuit comprises a transformer which has two windings. One of the windings is connected to the cable facility. The other winding has two terminals and an impedance generating means is connected between this winding and the transmission device.

The impedance generating means includes a first selectable switch means which is used to select one of a predetermined number of resistances. Each of the resistances are associated with a selected one of the predetermined number of selectable impedances. The impedance generating means also includes a negative resistance generating means which has an input and an output.

The first selectable means is connected to one terminal of the transformer's other winding and the input of the impedance generating means. The output of the impedance generating means is connected to the other terminal of the other winding to thereby form a loop. The negative resistance means responds to the current flowing in the loop to thereby present a negative resistance at the other terminal.

DESCRIPTION OF THE DRAWING

FIG. 1 shows a transformer providing selectable impedances which is embodied in accordance with the prior art.

FIGS. 2*a, b* and *c,* show schematic diagrams of a transformer and associated circuitry in order that the principles underlying the present invention may be described.

DESCRIPTION OF THE PREFERRED EMBODIMENT

Figures 3A, 3B, 3C, 3D, 4:
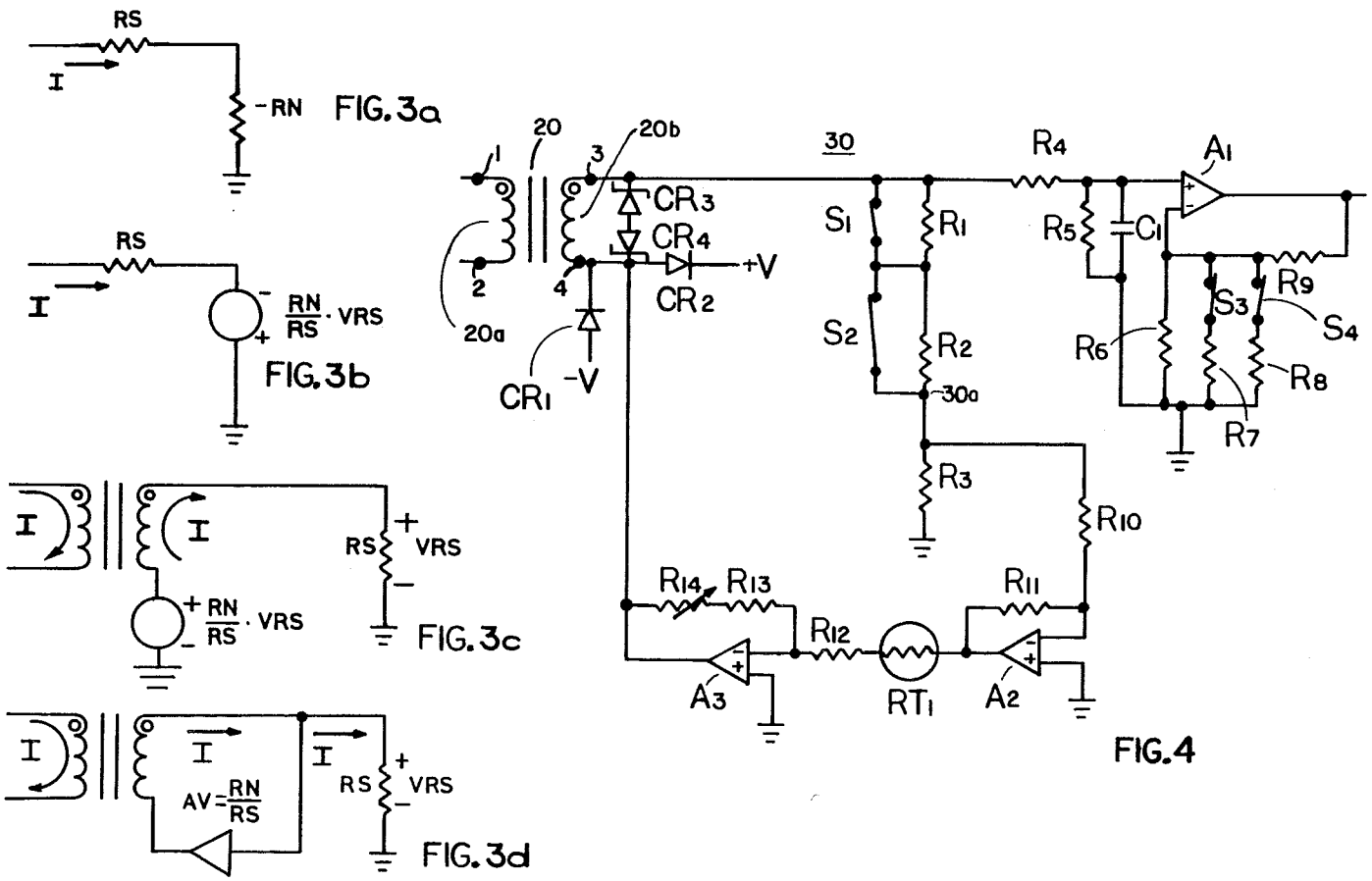
FIGS. 3*a, b, c,* and *d* show circuit diagrams which further illustrate the principles underlying the present invention.
FIG. 4 is a schematic diagram of an embodiment of the present invention for use in connecting the receiving part of a transmission device to a cable pair.

Referring to FIG. 1 there is shown in simplified form a transformer 10, embodied in accordance with the prior art which provides impedances selectable at either 150, 600 or 1200 ohms. The right hand winding 10*b* of the transformer is connected to the transmission device which for ease of illustration has been shown as a resistive load, RL. The left hand winding 10*a* of the transformer is made up of upper and lower parts. The upper and lower parts each include three taps which allow the left hand winding to be connected to the tip (T) and ring (R) conductors of the cable facility (pair) in a manner so as to provide the selectable impedances. The left hand winding also includes a center tap which is connected to the simplex (SX) wire of the cable facility.

It should be appreciated that the transmission device may be located at either and/or both ends of the cable facility. For example, the transmission device may be a data auxiliary unit and would therefore be located at the subscriber's facility. The transformers (one each for transmit and receive) and other circuitry of the device may then interface the four wire cable facility to a four wire or two wire data modem. FIG. 1 shows only one of the two transformers. The transmission device might also be a central office located data line conditioning or interface unit. The device would then interface the four wire cable facility to other central office located transmission equipment or to long haul four wire transmission facilities.

A switching arrangement is also included in conjunction with the left hand winding in order that the required impedance may be selected. For purposes of illustration the switch, designated as S, is shown in FIG. 1 in the position which connects the tip conductor to the tap connected to the upper end of the left hand winding 10*a* and which connects the ring conductor to the lower end of the winding 10*a*. This connection selects an impedance of 1200 ohms. By connecting the tip and ring conductors to the other taps on the upper and lower parts of the left hand winding 10*a*, an impedance of either 600 ohms or 150 ohms may be selected. Since only a portion of the left hand windings are used in the 150 ohm connection, and because the tapped left hand windings step down the resistance of the right hand windings and load, the high winding resistance problem previously described is substantially relieved.

In order that the prior art transformer of FIG. 1 provide both the required taps and adequate longitudinal balance it is necessary that the tapped left hand winding 10*a* be bifilar wound, which complicates the fabrication and increases the expense of the transformer. In addition, in the desired pot core type of transformer at least a nine (9) pin and more commonly a ten (10) pin bobbin must be used. The switch S, must withstand surge voltages.

Before describing an embodiment of the present invention for interfacing the receiving and transmitting circuits of a transmission device such as a data auxiliary unit with a cable facility, the principles underlying the invention will first be described. Referring now to FIG. 2*a* is shown a transformer 20 having its left hand winding 20*a* connected to the cable pair and its right hand winding 20*b* connected to the circuits (not shown) of the transmission device. The transformer has a one to one (1:1) turns ratio. The resistance of the left and right hand windings, RWL and RWR respectively, are each equal to 86 ohms. It is clear that as the total winding resistance of the transformer is 172 ohms there is no physical resistor of any value which can allow a 150 ohm input impedance to be presented at the cable pair.

A zero ohm resistance (short circuit) provides the best realizable return loss in this case. The voltage and the power delivered to the short circuit is zero and the loss is infinite. Even if the total winding resistance of the transformer were slightly less than 150 ohms, and a physical resistor having a resistance greater than zero ohms could be used to reach the desired 150 ohm input impedance, the losses would be excessive.

Referring now to FIG. 2*b* there is shown the transformer 20 of FIG. 2*a* wherein a negative resistance of −22 ohms has been connected across the right hand winding 20*b* of the transformer. Assuming once again that the left hand winding 20*a* is connected to the cable pair and that the transformer has a one to one turns ratio and a resistance of 86 ohms in each winding, then the connection of the −22 ohm resistor across the right hand winding gives rise to an input impedance of 150 ohms at the cable pair. The gain G or in this case the loss, L, of the transformer in dB is given by the following equation:

$$L = 20 \text{ Log} \frac{(RWT - RN)}{(RN)} \tag{1}$$

Where RWT is the total winding resistance of the transformer and RN is the absolute value of the negative resistor connected across the right hand winding.

For the transformer shown in FIG. 2*b*

RN=22 ohms

RWT=RWL+RWR=172 ohms and

L=16.67 dB.

Referring now to FIG. 2*c* there is shown the transformer 20 of FIG. 2*a* wherein a resistor having a resistance of 215 ohms is connected between the upper end of the right hand winding 20*b* and ground and a resistor, having a resistance of −237 ohms, is inserted between the lower end of the right hand winding and ground. Once again the transformer has a one to one turns ratio and the resistance of each winding is 86 ohms. The total resistance on the right hand side of the transformer is 64 ohms and the input impedance to the cable pair is 150 ohms.

The loss or as it will turn out in this case the gain, G, in dB through the transformer is given by the following equation:

$$G = 20 \text{ Log} \left( \frac{RP}{RWT + RP - RN} \right) \tag{2}$$

Where RP is the resistance of the real physical resistor and RWT and RN are as defined for equation 1.

For the transformer of FIG. 2*c*

RP=215 ohms

RWT=172 ohms

RN=237 ohms and the gain, G, is

G=3.13 dB

Therefore the combination of a real physical resistor and a negative resistance arranged as shown in FIG. 2*c* gives rise to a gain.

In addition the total dc resistance of the loop of the right hand side of the transformer must always be greater than zero in order that the circuit have stability. For the transformer shown in FIG. 2*c*, that resistance is 64 ohms and the circuit is stable. Finally the net negative resistance on the right hand side of the transformer is the sum of RP-RN. For the transformer of FIG. 2*c* the net negative resistance is −22 ohms.

The winding resistance of the transformer is dependent upon the resistivity temperature coefficient of the material (copper) used to make the windings. The winding resistance therefore changes at the rate of the temperature coefficient of copper, i.e. 0.39% for each one centigrade degree change in temperature. If the change in the net negative resistance with temperature can be made to equal the change in total transformer winding resistance, then the effective copper loss of the transformer will become temperature stable. In other words the input impedance at the cable pair will always be equal to 150 ohms independent of temperature. In addition as the denominator of equation 2 is the input impedance, the maintaining of that impedance at 150 ohms independent of temperature will also cause the gain to be independent of variations in temperature.

It should be appreciated that the requirement that the net negative resistance equal the change in total transformer resistance may cause that resistance to become positive. As the temperature drops from the quiescent level, which may for example be room temperature (20° C.), the total winding resistance decreases from its nominal value of 172 ohms. Each 10° C. drop in temperature causes the total winding resistance to decrease by approximately 6.7 ohms. When the temperature has dropped by slightly more than 30° C., the total winding resistance has decreased to 150 ohms. Further decreases in temperature cause the total winding resistance to decrease below 150 ohms. In order for the total input impedance to remain fixed at 150 ohms the sum of RP-RN (the up to now net negative resistance) must then become positive.

A further understanding of the principles underlying the invention may be had by referring to FIG. 3*a* which shows a simple series circuit comprised of resistor, RS, and a hypothetical negative resistor, of magnitude, RN. A current, I, is assumed to flow through the circuit as shown. With the voltage drop across resistor RS being designated as VRS and the voltage drop across the negative resistor being designated as VRN it can be shown that $$VRN = -\frac{RN}{RS} \cdot VRS \tag{3}$$

The above equation implies that the negative resistor may be regarded as a dependent voltage source phased in such a direction as to enhance rather than impede current flow in the circuit. The magnitude of that source is dependent upon the voltage drop across resistor RS. The resistor RS may then be regarded as a current sensing resistor. Therefore the circuit shown in FIG. 3*a* may be replaced by the circuit shown in FIG. 3*b*. In that circuit the negative resistor of FIG. 3*a* has been replaced by the voltage source having the magnitude and polarity shown.

Referring now to FIG. 3*c* there is shown a rearrangement of the circuit of FIG. 3*b* which introduces an ideal transformer having a one to one turns ratio. The introduction of the transformer allows the circuit of FIG. 3*b* to be rearranged so that it is similar in arrangement to the circuit shown in FIG. 2*c* described above. From a comparison of FIGS. 3*c* and 2*c* it is clear that the dependent voltage source still functions as a negative resistor.

Referring now to FIG. 3*d* there is shown in simplified form the technique used by the present invention to generate negative resistance. The amplifier shown therein is understood to be referenced to circuit common, has infinite input impedance, zero output impedance and a voltage gain designated as AV. As the current flowing into the input of the amplifier is zero all of the current I in the circuit of FIG. 3*d* flows through resistor RS to produce a voltage VRS. A voltage appears at the output of the amplifier and therefore at the lower end of the right hand winding of the transformer (referenced to circuit common) which is AV times the voltage VRS. It is clear that the circuit shown in FIG. 3*d* is equivalent to that shown in FIG. 3*c* and that the amplifier has realized the negative resistor at its output.

Referring now to FIG. 4 there is shown an embodiment of the circuit 30 of the present invention for use in connecting the receiving part of a transmission device to a cable pair. For ease of description it will be assumed hereinafter that the transmission device is a data auxiliary unit and circuit 30 interfaces the receiving part of the unit to a four wire cable. Circuit 30 includes a transformer which is identical to that described in connection with FIGS. 2*a*, 2*b* and 2*c* and is therefore designated as 20. The left hand winding 20*a* of the transformer has its upper and lower terminals 1 and 2, respectively, connected to the T and R conductors of the cable pair. The right hand winding 20*b* of the transformer has its upper and lower terminals 3 and 4, respectively, connected to the remainder of circuit 30.

Circuit 30 allows a temperature independent and substantially constant input impedance selectable at either 150, 600, or 1200 ohms to be presented to the cable pair. To that end circuit 30 includes the four switches designated as S1, S2, S3 and S4 in FIG. 4. Switches S1 and S2 are connected in parallel across the associated resistors R1 and R2 whereas switches S3 and S4 are connected in series with the associated resistors R7 and R8. By selectively turning the switches on and off the required input impedance can be selected. The setting of the switches for selecting either 150, 600 or 1200 ohms is given in Table 1 below.

TABLE 1

| | | SWITCH SETTING | | | |
|---|---|---|---|---|---|
| | | S1 | S2 | S3 | S4 |
| INPUT | 150 | ON | ON | ON | ON |
| IMPEDANCE | 600 | ON | OFF | ON | OFF |
| OHMS | 1200 | OFF | OFF | OFF | OFF |

Therefore the switches are shown in FIG. 4 in the setting that selects an input impedance of 150 ohms.

Terminal 3 of winding 20*b* is connected to one end of the series combination of resistors R1, R2, and R3. The other end of the series combination being connected to circuit common or ground. As described above switches S1 and S2 are connected in parallel across resistors R1 and R2, respectively.

Terminal 3 is also connected by the series resistor R4 to the non-inverting input of amplifier A1 and to one end of the parallel combination of resistor R5 and capacitor C1. The other end of the parallel combination is connected to circuit common. The inverting input of amplifier A1 is connected by the parallel combination of resistor R6; switch S3 in series with resistor R7; and switch S4 in series with resistor R8 to circuit common. A resistor R9 also connects the inverting input to the output of the amplifier. The output of the amplifier is connected to the receiving circuit of the data auxiliary unit.

Junction 30*a* of resistor R2 with the end of resistor R3 not connected to circuit common is connected by a resistor R10 to the inverting input of amplifier A2. The inverting input is connected by resistor R11 to the amplifier's output. The non-inverting input is connected to circuit common.

The output of amplifier A2 is connected by the series combination of a temperature sensitive resistor (thermistor) RT1 and a resistor R12 to the inverting input of amplifier A3. The non-inverting input of the amplifier is connected to circuit common. The inverting input is connected by the series combination of fixed resistor R13 and adjustable resistor R14 to the amplifier's output. The output is also connected directly to terminal 4 of winding 20*a*.

Resistor R3 acts as a current sensing resistor (corresponding to RS in FIG. 3*d*) to thereby provide a voltage proportional to the current flowing in the loop associated with winding 20*b*. Amplifier A2 in combination with resistor R10 and R11 which are of equal resistance forms a unity gain amplifier. The voltage provided by resistor R3 is delivered to the unity gain amplifier and appears inverted in polarity at the output of A2.

Amplifier A3 in combination with temperature sensitive resistor RT1 and resistors R12, R13 and R14 form a second inverting amplifier. The amplifiers A2 and A3 in combination with the resistors R3, R10, R11, R12, R13, R14 and RT1 form a negative resistance generator corresponding to the amplifier of FIG. 3*d* with temperature compensation added as will be described. The negative resistance, RN, presented by the generator at terminal 4 is determined by adjusting the resistance of resistor R14. With switches S1 and S2 in the position shown in FIG. 4 the net negative resistance on the right hand side of transformer 20 in the sum of R3-RN. If transformer 20 is identical to the transformer described in connection with FIG. 2*c* then if the net negative resistance is −22 ohms, the resistance appearing across terminals 1, 2 of winding 20*a* is then 150 ohms as required.

For the reasons discussed in connection with FIG. 2*c* it is desirable that the negative resistance generator present a negative resistance of −237 ohms at terminal 4 of winding 20*b*. In order for that resistance to be generated it is therefore necessary that the resistors R3, R10 to R14 and RT1 have the following resistances:

R3=215 ohms
R10=100 Kohms
R11=100 Kohms
R12=8250 ohms
R13=9090 ohms
R14=1100 ohms - nominal (is adjustable)
RT1=1000 ohms at 25° C.

Therefore with both switches S1 and S2 in the on position the net negative resistance on the right hand side of the transformer is the required −22 ohms.

In order that the circuit of the present invention also provide the required 600 and 1200 ohm input impedances across windings 1, 2 with the switches S1 and S2 having the settings shown in Table 1 then resistors R1 and R2 should have the following resistances:

R1=600 ohms
R2=450 ohms

Therefore with switch S2 off, the input impedance across terminals 1, 2 is 600 ohms and with both switches S1 and S2 off the input impedance across the terminals is 1200 ohms.

The thermistor RT1 has a temperature coefficient which is many times greater than the temperature coefficient of copper and is also opposite in phase to that of copper. Therefore as the temperature decreases from 25° C. the resistance of RT1 increases above 1000 ohms at a faster rate than the rate at which the resistance of the windings of transformer 20 decreases. It is, however, required that the net change in negative resistance, (RN-R3), equal the change in winding resistance of transformer 20. To that end resistors R12, R13 and R14 are selected to have the resistances set forth above. In this manner the required negative resistance is generated and the change in net negative resistance with temperature equals the change in winding resistance of transformer 20. Thus, the input impedance appearing across terminals 1, 2 of winding 20*a* will always be at the required impedance (150 or 600 or 1200 ohms) independent of temperature.

As set forth by equation (2), discussed in connection with FIG. 2*c* the gain G, through the transformer for the 150 ohm input impedance is 3.13 dB. For the 600 ohm input impedance, switch S2 is off and the gain through the transformer may be calculated as 0.89 dB. For the 1200 ohm input impedance both switches S1 and S2 are off and the gain through the transformer may be calculated as 0.46 dB. Therefore, the negative resistance generating portion of the circuit of the present invention provides a gain dependent on the selected input impedance with that gain being a maximum at 150 ohms and a minimum at 1200 ohms.

Circuit 30 connects the cable pair to the receiving circuitry of the data auxiliary unit. To this end terminal 3 of winding 20*b* could be connected directly to that receiving circuitry if the impedance of such circuitry were sufficiently high. If this were done, however, the voltage delivered by circuit 30 to the receiving circuitry at a given input power would depend on the input impedance selected. This is true because, as described above, the voltage gain through the transformer varies with the input impedance selected. In addition, if a signal having one milliwatt of power (zero (0) dBm) is applied across terminals 1, 2 of winding 20*a*, i.e. the input to circuit 30, the voltage developed across those terminals will be dependent on the input impedance selected. A zero dB input signal provides three (3) dB more voltage at 1200 ohms than the voltage provided at 600 ohms and six (6) dB less voltage at 150 ohms than the voltage at 600 ohms. To the end that the gain or loss of the data auxiliary unit shall not depend on the impedance selected, there is the requirement that a signal of zero dBm applied across the input to circuit 30 give rise at the output of the circuit to a voltage which is equivalent to zero dBm in a 600 ohm resistor. That voltage is 0.775 VRMS. In order to meet that requirement it is therefore necessary to include in circuit 30 an amplifier whose gain varies with the selected input impedance. It is further required that this amplifier have a maximum gain when the input impedance is selected to be 150 ohms and a minimum gain when that impedance is selected to be 1200 ohms.

To that end, circuit 30 includes amplifier A1 and its associated circuit elements. Terminal 3 of winding 20*b* is connected to one end of a resistor R4. The other end of the resistor is connected to one end of the parallel combination of a resistor R5 and a capacitor C1 and to the non-inverting, input of amplifier A1. The other end of the parallel combination is connected to circuit common. Resistors R4 and R5 function as an attenuator and capacitor C1 acts as a radio frequency filter. The amount of attenuation provided by resistors R4 and R5 is independent of the input impedance selected and is dependent solely on the resistances of those resistors.

The inverting input of amplifier A1 is connected to circuit common by a resistor R6 which is in parallel with both the series combination of switch S3 and resistor R7 and the series combination of switch S4 and resistor R8. The inverting input is also connected to the output of the amplifier, and therefore to the output of circuit 30, by a resistor R9.

The gain of amplifier A1 is always greater than unity. The specific gain of the amplifier is dependent on the setting of switches S3, S4 and the resistances selected for resistors R6, R7, R8 and R9. As described above that gain must be a maximum when the 150 ohm input impedance is selected (switches S3, S4 both on) and a minimum when the 1200 ohm input impedance is selected (switches S3, S4 both off).

The resistances selected for resistors R4, R5, R6, R7, R8 and R9 are:

R4=200 Kohms
R5=294 Kohms
R6=38.3 Kohms
R7=13.0 Kohms
R8=6.19 Kohms
R9=4.99 Kohms The attenuator made up of R4 and R5 therefore provides 4.5 dB of attenuation independent of the input impedance selected. Amplifier A1 provides about 7.3 dB of gain when the 150 ohm input impedance is selected, about 3.6 dB of gain when the 600 ohm input impedance is selected and about 1.06 dB of gain when the 1200 ohm input impedance is selected. Therefore amplifier A1 provides a variable gain which is a maximum at 150 ohms and a minimum at 1200 ohms. This variable gain in combination with the impedance related gain provided by the transformer and the constant attenuation provided by R4 and R5 allows circuit 30 to give rise to, independent of the input impedance selected, a voltage of 0.775 VRMS at its output when a zero dBm signal is applied to its input.

In summary, circuit 30 has provided an effective transformer winding resistance of 150 ohms. This resistance remains constant independent of temperature. Operation of switches S1, S2 then allows the input impedance to be selected at either 150, 600 or 1200 ohms. Both the return loss and gain provided by circuit 30 depend only on the values selected for the resistors R1 to R14 of the circuit. If those resistors are embodied by using precision components then the return loss and gain may both be accurately determined, except for temperature tracking errors. These errors are, however, quite small over the range of temperatures for which the circuit is intended to be operated. This temperature range is typically from −18° C. to +49° C.

The procedure for adjusting the circuit is as follows: the 150 ohm input impedance is selected by closing all of the switches. The proper setting for adjustable resistor R14 is then established by either accurately setting the gain or optimizing the low frequency return loss. Thereafter both the gain and return loss are compensated with changes in temperature for all settings of switches S1 to S4.

Diodes CR1 and CR2 both connected to terminal 4 of winding 20*b* and zener diodes CR3, CR4 connected in series across the winding provide surge protection. Capacitor C1 has a capacitance of 22 picofarads.

Figure 5:
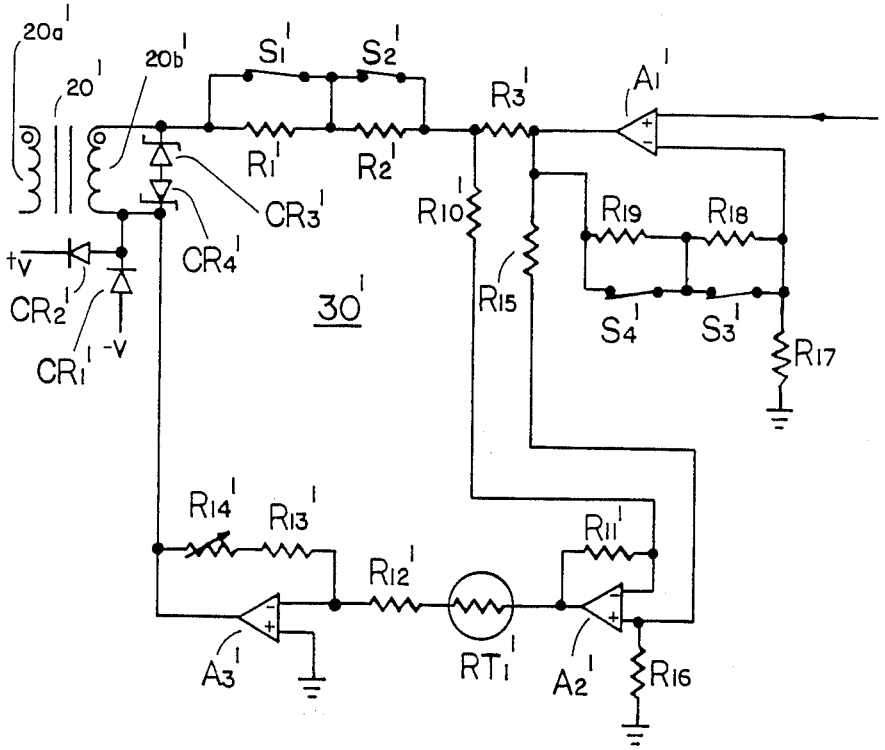
FIG. 5 is a schematic diagram of an embodiment of the present invention for use in connecting the transmitting part of a transmission device to a cable pair.

Referring now to FIG. 5 there is shown an embodiment of the circuit of the present invention for use in connecting the transmitting circuitry of the data modem to the cable pair. As this circuit is substantially identical to circuit 30 it is designated as 30′. Components and terminals of circuit 30′ identical to those in circuit 30 carry the same designator along with a prime to indicate that they are part of circuit 30′. Therefore resistors R1′, R2′, R3′, R10′, R11′, R12′, R13′, R14′ and RT1′ are identical to and have the same function and resistance as like designated resistors of circuit 30.

Amplifiers A2′ and A3′ and their associated resistors function in a manner identical to amplifiers A2 and A3 of circuit 30 to generate a temperature compensated negative resistance such that the net winding resistance of transformer 20′ is maintained at 150 ohms. The principal difference between the negative resistance generator of circuit 30′ and the generator of circuit 30 is that amplifier A2′ requires a differential input from the loop current sampling resistor, R3′, whereas the amplifier A2 requires only a single ended input from the resistor, R3. To that end circuit 30′ includes resistor R15 connected between resistor R3′ and the non-inverting input of A2′ and resistor R16 connected between the non-inverting input and ground.

Circuit 30′ also includes amplifier A1′. The non-inverting input of A1′ is connected to the output of the data auxiliary unit's transmitting circuit. The inverting input is connected to ground by a resistor R17 and by the series combination of resistors R18 and R19 to the output of the amplifier. Switch S3′ is in parallel with resistor R18 and switch S4′ is in parallel with resistor R19. The output of the amplifier is connected to R3′ and to R15 at the junction designated as 30*a*′.

Circuit 30′ provides a selectable output impedance across terminals 1′, 2′ of winding 20*a*′. This impedance is selectable at either 150, 600 or 1200 ohms depending on the settings of switches S1′, S2′, S3′ and S4′. The settings of these switches in order to realize a selected one of the three required output impedances are identical to those given in Table 1 above for realizing the same impedance at the input to circuit 30.

The voltage gain, G, of circuit 30′ from junction 30*a*′, i.e. the output of amplifier A1′, to winding 20*a*′ of transformer 20′ for any of the selectable output impedances is given from the following equation:

$$G = 20 \text{ Log} \frac{RT}{2RT} = 6\text{dB} \quad (4)$$

Where RT is the total resistance of resistors R3′, R1′ and R2′, if the associated switches are open, the generated negative resistor, and the resistance of both transformer windings. Therefore, the combination of transformer 20′ and the negative resistance generator made up of amplifiers A2′ and A3′ does not provide any voltage gain in circuit 30′. Rather this combination produces a voltage loss which is constant and independent of the setting of the switches. This is in contrast to circuit 30 wherein the combination of transformer 20 and the negative resistance generator provides a gain which varies from a maximum at 150 ohms to a minimum at 1200 ohms.

In a manner reciprocal to the case of circuit 30, described above, circuit 30′ must meet the requirement that a signal of 0.775 VRMS applied across its input give rise at the output of the circuit to a voltage which is equivalent to 0 dBm at the selected output impedance. As the combination of transformer 20′ and the negative resistance generator provide a loss which is constant and independent of the output impedance selected it is therefore required that amplifier A1′ provide a gain which varies with the selected impedance. In particular it is required that amplifier A1′ provide 0 dB of gain at 150 ohms, +6 dB of gain at 600 ohms, and +9 dB of gain at 1200 ohms. This variable gain of A1′ is provided by switches S3′, S4′ and their associated resistors R18 and R19.

In one embodiment of circuit 30′ the resistances selected for resistors R15, R16, R17, R18 and R19 were:

R15=R16=100 Kohms

R17=R19=10.0 Kohms

R18=8.25 Kohms

As described above for circuit 30 the procedure for adjusting circuit 30′ is to first select the 150 ohm output impedance by closing all of the switches. The proper setting for adjustable resistor R14′ is then established by either accurately setting the gain or optimizing the low frequency return loss.

It should be appreciated that the transformers shown in FIGS. 4 and 5 may also include a center tap in their left hand windings as shown in FIG. 1 for the transformer embodied in accordance with the prior art. This center tap, as described previously, is used to derive a simplex (longitudinal) connection to the cable facility. It should further be appreciated that the transformers of FIGS. 4 and 5 can be implemented simply by using two pot core halves and a bobbin having no more than five (5) pins. If it was desired to eliminate the center tap, then only a four (4) pin bobbin need be used. This is in contrast to the transformer of FIG. 1 which requires a nine or ten pin bobbin, when it is implemented, using the desired pot core.

It should also be appreciated that while FIGS. 4 and 5 have been described in connection with transformers having a one to one turns ratio that such a ratio is not critical to the operation of the present invention.

It should further be appreciated that the problem solved by the present invention arises as a result of the requirements that the transformer provide both a selectable input and/or output impedance and a certain desired envelope delay distortion characteristics. It is the combination of these requirements which causes the total winding resistance of the transformer to become so large as to either dominate or exceed the lowest desired selectable impedance. In the former situation, the transformer is extremely lossy while in the latter it becomes impossible to have the lowest desired selectable impedance. The present invention allows both of these requirements to be met using a relatively simple pot core transformer.

It should be further appreciated that with the present invention, the gain and low frequency return loss are no longer independent of each other. Once the circuit is adjusted to set either parameter, then the other parameter is automatically set. The accuracy to which both parameters are set is dependent solely on the accuracy of the precision resistors used in the circuit.

It is to be understood that the description of the preferred embodiment is intended to be only illustrative, rather than exhaustive, of the present invention. Those of ordinary skill will be able to make certain additions, deletions, and/or modifications to the embodiment of the disclosed subject matter without departing from the spirit of the invention or its scope, as defined by the appended claims.

What is claimed is:

1. A compensated circuit for use in interfacing a transmission device to a cable facility comprising:

(a) transformer means having first and second windings, said first winding being connected to said cable facility and said second winding having first and second terminals; and (b) impedance generating means connected between said second winding and said transmission device comprising:

(i) first selectable switch means for selecting one of a predetermined number of resistances each of said resistances being associated with a selected one of a predetermined number of selectable impedances; and (ii) negative resistance generating means having an input and an output, said first selectable means being connected between said first terminal and said input, said output being connected to said second terminal to thereby form a loop, said negative resistance generating means being responsive to the current flowing in said loop for presenting a negative resistance at said second terminal such that said circuit provides to said cable facility said selected one of said predetermined number of selectable impedances.

2. The circuit of claim 1 wherein said negative resistances generating means includes an adjustable value resistance means, the value of said negative resistance being constant and determined by the setting of said adjustable value resistance means.

3. The circuit of claim 1 wherein said negative resistance generating means includes a temperature compensated resistance means having a resistivity temperature coefficient selected to be opposite in phase to the resistivity temperature coefficient of said first and second windings such that said circuit provides said selected one of said predetermined number of selectable impedances independent of changes in temperature.

4. The circuit of claim 2 wherein said negative resistance generating means further includes a temperature compensated resistance means having a resistivity temperature coefficient selected to be opposite in phase to the resistivity temperature coefficient of said first and second windings such that said circuit provides said selected one of said predetermined number of selectable impedances independent of changes in temperature.

5. The circuit of claim 1 wherein said first selectable switch means includes first and second resistors connected in series between said first terminal and said negative resistance generating means input and first and second switch means connected in parallel across a respective one of said first and second resistors.

6. The circuit of claim 2 wherein said first selectable switch means include first and second resistors connected in series between said first terminal and said negative resistance generating means input and first and second switch means connected in parallel across a respective one of said first and second resistors.

7. The circuit of claim 3 wherein said first selectable switch means include first and second resistors connected in series between said first terminal and said negative resistance generating means input and first and second switch means connected in parallel across a respective one of said first and second resistors.

8. A compensated circuit for use in interfacing a transmission device to a cable facility comprising:

(a) transformer means having first and second windings, said first winding being connected to said cable facility and said second winding having first and second terminals; and (b) impedance generating means connected between said second winding and said transmission device comprising:

(i) first selectable switch means for selecting one of a predetermined number of resistances each of said resistances being associated with a selected one of a predetermined number of selectable impedances; and (ii) negative resistance generating means having an input and an output and including an adjustable value resistance means, said first selectable means being connected between said first terminal and said input, said output being connected to said second terminal to thereby form a loop, said negative resistance generating means being responsive to the current flowing in said loop for presenting a constant value negative resistance at said second terminal, the value of said negative resistance being determined by the setting of said adjustable value resistance means, such that said circuit provides to said cable facility said selected one of said predetermined number of selectable impedances.

9. The circuit of claim 8 wherein said negative resistance generating means further includes a temperature compensated resistance means having a resistivity temperature coefficient selected to be opposite in phase to the resistivity temperature coefficient of said first and second windings such that said circuit provides said selected one of said predetermined number of selectable impedances independent of changes in temperature.

10. The circuit of claim 8 wherein said first selectable switch means includes first and second resistors connected in series between said first terminal and said negative resistance generating means input and first and second switch means connected in parallel across a respective one of said first and second resistors.

11. The circuit of claim 9 wherein said first selectable switch means include first and second resistors connected in series between said first terminal and said negative resistance generating means input and first and second switch means connected in parallel across a respective one of said first and second resistors.

* * * * *